US005993053A

United States Patent [19]

Clark

[11] Patent Number: 5,993,053

[45] Date of Patent: Nov. 30, 1999

[54] APPARATUS AND METHOD FOR CONVECTIVE STIRRING OF FINELY-DIVIDED PARTICLES IN LIQUID TONER

[76] Inventor: Lloyd Douglas Clark, 15 Conrad St., San Francisco, Calif. 94131

[21] Appl. No.: 09/002,969

[22] Filed: Jan. 5, 1998

[51] Int. Cl.[6] ..... B01F 5/10; B01F 15/06

[52] U.S. Cl. ..... 366/146; 366/144; 399/254

[58] Field of Search ..... 366/144–146, 366/342, 348, 349; 399/253, 254, 255; 222/DIG. 1

[56] References Cited

U.S. PATENT DOCUMENTS 3,782,699 1/1974 Canning ..... 366/144
4,814,786 3/1989 Hoisington et al. .
5,066,517 11/1991 Hanson et al. .
5,520,763 5/1996 Johnstone .
5,682,584 10/1997 Hattori et al. ..... 399/255
5,823,676 10/1998 Khijniak et al. ..... 366/144
5,835,827 11/1998 Kishimoto ..... 399/254
5,835,828 11/1998 Jyoroku ..... 399/256

*Primary Examiner*—Charles E. Cooley

[57] ABSTRACT

Electrographic toner fluid (15), contained in a reservoir (10), is convectively stirred through the application of a non-uniform thermal gradient by a heater (20). Convective flow in fluid (15) entrains colloidal particles (35) and other dissolved agents and causes them to be uniformly dispersed in the fluid (15), thus rendering the fluid (15) homogeneous and capable of making uniform prints. The heater (20) may be inside or outside the reservoir (10) and may comprise separate heaters, alternately or simultaneously energized.

12 Claims, 6 Drawing Sheets

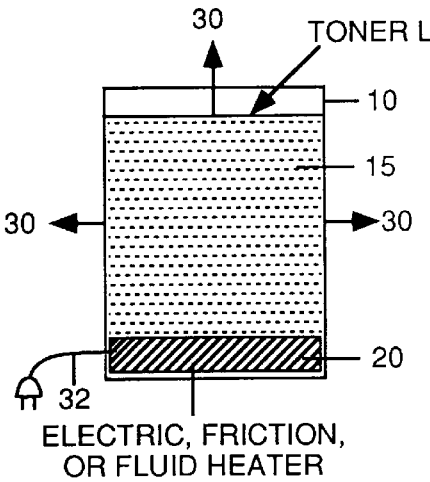
FIG. 1A—FRONT VIEW
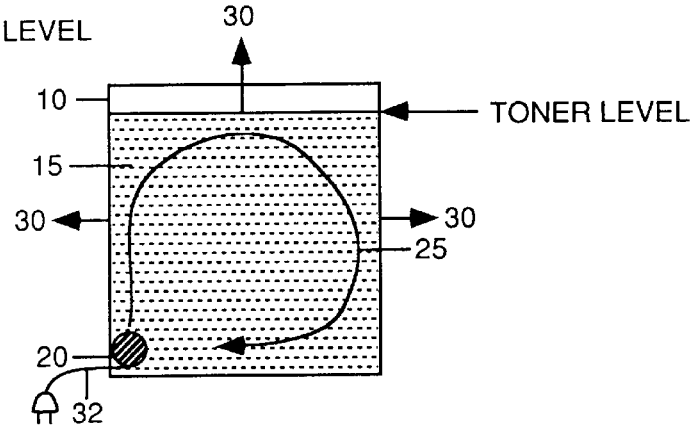
FIG. 1B—SIDE VIEW
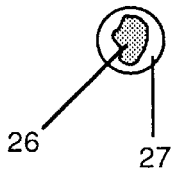
FIG. 1B' ENLARGED VIEW
OF TONER PARTICLE
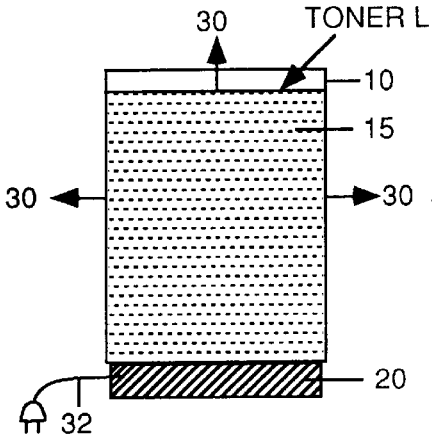
FIG. 2A—FRONT VIEW
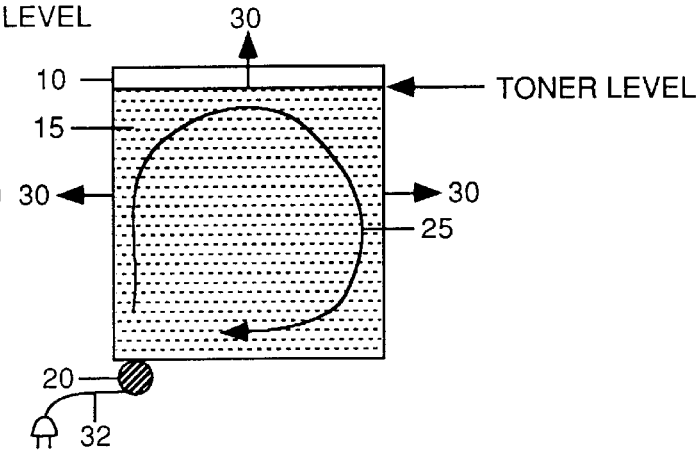
FIG. 2B—SIDE VIEW

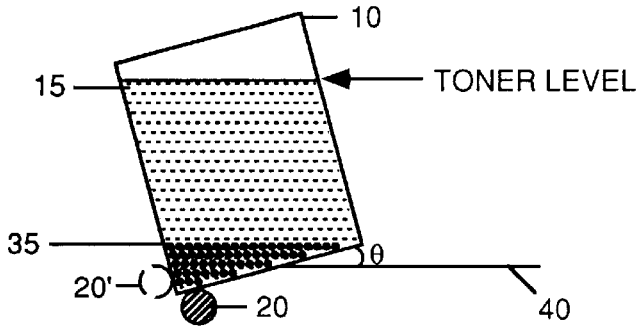
FIG. 3A. HEAT OFF
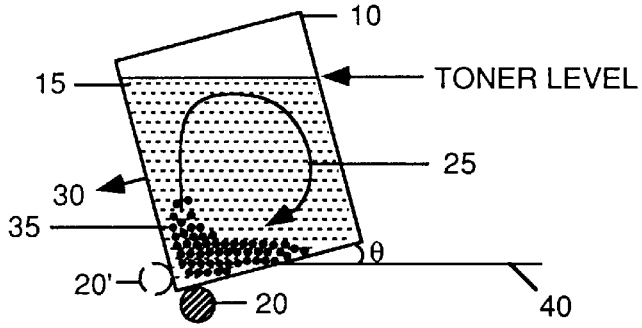
FIG. 3B. HEAT ON FOR A SHORT PERIOD
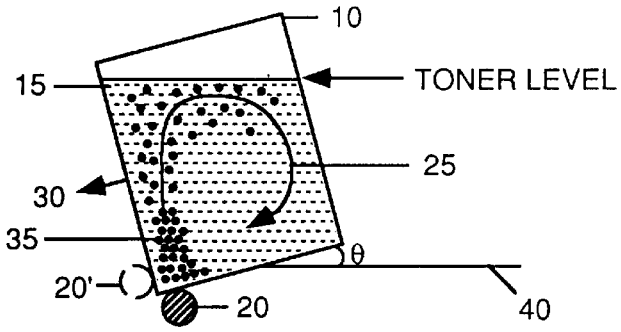
FIG. 3C. HEAT ON FOR A LONGER PERIOD
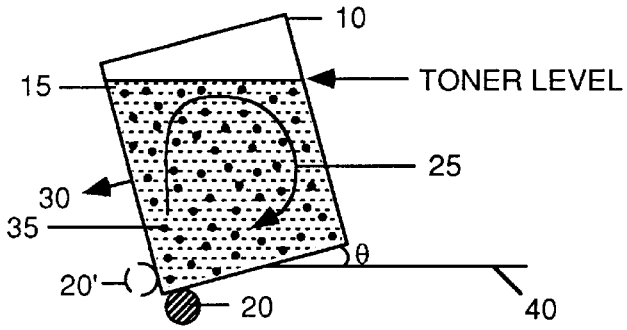
FIG. 3D. HEAT ON FOR A VERY LONG PERIOD

APPARATUS AND METHOD FOR CONVECTIVE STIRRING OF FINELY-DIVIDED PARTICLES IN LIQUID TONER

BACKGROUND

1. Field of Invention

This invention relates to the field of electrographic printers, specifically to a treatment for liquid toners used in such printers.

2. Prior-Art

Toner for Electrographic Printers

Electrographic printers are manufactured and sold by Xerox ColorgrafX Systems, Inc., 5853 Rue Ferrari, San Jose, Calif. 95138 U.S.A., and others. These printers typically comprise a supply roll of electrographic medium (typically a specialized paper), one or more electrographic writing heads, one or more "developing stations," a drive roller for moving the medium, and a take-up roller for spooling the medium after it is printed. The writing head deposits an electrical charge image on the medium, and the developing station applies liquid "toner" to the medium. Colored particles in the toner adhere to the charge pattern corresponding to the image to make the image visible. The toner air-dries, evaporating a solvent liquid to permanently adhere the particles to the medium.

Electrographic toner mainly comprises a slurry of electrically charged, colored, colloidal (sub-micron)-sized particles in a solvent vehicle. Other components of toner are also suspended and dissolved in the liquid vehicle. These ensure maintenance of the proper level of electrical conductivity in the toner, cause proper adhesion of the toner particles to the receiving medium, and provide for long toner life. Such toner is manufactured by Hilord Chemical Corporation, 70 Engineers Road, Hauppauge, N.Y. 11588 U.S.A. and others.

During printing, electrographic printers recirculate liquid toner from a reservoir where it is stored, through a "developing station," and back to the reservoir. At the developing station, the surface of the print medium is flooded with toner. Toner particles adhere to the medium in places where electrical charges have been deposited. They do not adhere elsewhere. The result is a visible image of the original, invisible electrical charge image.

As mentioned supra, the diameter of toner particles is typically less than one micron and other agents which are both suspended and dissolved in the toner vehicle also contribute to the toner's electrical, mechanical, and optical properties. This mixture of particles and complex liquid vehicle must be maintained in an homogeneous state in order for high-quality, consistent prints to be obtained. Gravitational forces cause suspended particles to settle to the bottom of their container. Because of their small size, the toner particles settle very slowly, typically in a few tens of hours. The toner particles are typically not adequately stirred by the pumping mechanisms in electrographic printers. This results in stratification of the toner in its container or reservoir. At the bottom of the reservoir is a slurry containing more particles than desired. These particles displace the chemical conductivity-control agents mentioned supra. The remaining toner liquid contains too few particles and has disproportionately high electrical conductivity. This non-homogeneity of the toner in the reservoir results in the printing of poor quality images.

It is mandatory that the concentration of charged, colored particles and other dissolved and suspended chemical conductivity-control agents in the toner remain constant during printing. If the concentration changes during the printing of an image, the optical density or saturation of the image will also change unpredictably, resulting in a degraded image. Settling of the toner cannot be allowed since this causes fewer toner particles to be recirculated and hence available for "developing" the image. A faint image, or one which changes from dark to faint during printing, can result.

Recirculation of the toner in the printer is generally inadequate to ensure that all the particles will remain suspended and that the slurry will be homogeneous. In some cases, the toner agglomerates at the bottom of the reservoir and cannot be dislodged, except by extraordinary means. These means include mechanically moving and shaking the toner reservoir to agitate the contents, periodically stirring the toner with a stick, and the like. None of these is adequate to ensure that the toner will remain in an homogeneous state for an indefinite period.

It has been known to stir various fluids by application of heat to cause convection currents in the fluid. For example, Hoisington, in U.S. Pat. No. 4,814,786 (1989) teaches the convective stirring of a non-electrographic solution, a hot-melt ink. However Hoisington's heaters must serve two distinct purposes. Heat is provided to raise the temperature of the ink to 120 deg. Celsius (248 deg. F) in two different vessels order to melt it. The same heat is applied in an asymmetrical fashion in both vessels additionally to provide convective stirring. The vessels are connected by a conduit which must be heated when it is desired to pump molten ink from one vessel to the other. Hoisington's printer will not work at all if his heaters are OFF since the ink becomes solid. Present electrographic printers, on the other hand, will work without proper stirring of the toner, but, as stated, image quality is degraded. Hoisington's ink typically comprises a simple suspension of pigment particles in a vehicle which changes state from solid to liquid and then from liquid to solid by phase changes during use. Liquid toner remains liquid and additionally contains a complex mixture of both dissolved and suspended chemical conductivity-regulating agents, particulates and plastic resins, described supra, all of which must be fully dispersed in the toner. Toner becomes so lid on the receiving me dium through evaporation of its liquid vehicle. No phase change is required. Hoisington's ink reservoirs are sufficiently small that only a single heat contact point is required to both melt and convect the molten ink. Electrographic printer toner reservoirs are sufficiently large that a heat source like Hoisington's will not be able to maintain adequate homogeneity by convective stirring.

Thus present electrographic printers suffer loss of print quality due to non-homogeneity of their toners. Prior-art stirring methods and apparatus do not render the toners homogeneous: hence print quality is variable, and thus degraded.

OBJECTS AND ADVANTAGES

Accordingly it is one object of this invention to provide an improved stirring method and apparatus for toners. It is another object to enable electrographic printers to print improved images using toners which have an homogeneous distribution of particles and other agents in a liquid vehicle. It is a further object to provide a stirring method and apparatus which are simple and inexpensive and which do not use mechanical pumps or mechanical agitation means. Yet another object is to provide a stirring method and apparatus which are able to properly stir electrographic toner in a reservoir which is large with respect to the size of an individual heater. Still further objects and advantages will become apparent from the ensuing description and drawings.

SUMMARY

In accordance with the present invention, a method and apparatus are provided which stir the toner in toner reservoirs in electrographic printers. Heat is applied to the liquid toner reservoirs in such a manner that convection within the toner fluid entrains toner particles. This entrainment causes the particles to be uniformly distributed within the liquid toner vehicle. The convective stirring also causes uniform distribution of other chemical components in the toner which contribute to its bulk conductivity. All toner components are uniformly distributed and superior print quality results. The method and apparatus are simple and inexpensive. They enable these printers to print high quality images using toners which would otherwise settle in their reservoirs. Results of the application of the instant methods and apparatus include at least higher quality prints and the ability to use particle-containing toners and to stir toners in large reservoirs.

BRIEF DESCRIPTION OF THE DRAWINGS

FIGS. 1A and 1B are front and side views of a reservoir containing toner and a heating element in accord with the invention. FIG. 1B' is an enlarged view of a toner particle.

FIGS. 2A and 2B are front and side views of a reservoir containing toner, with an external heating element in accord with the invention.

FIGS. 3A, 3B, 3C, and 3D are side views of a tilted reservoir containing toner, with an external heating element in accord with the invention.

DRAWING FIGURE REFERENCE NUMERALS

Figure 4A:
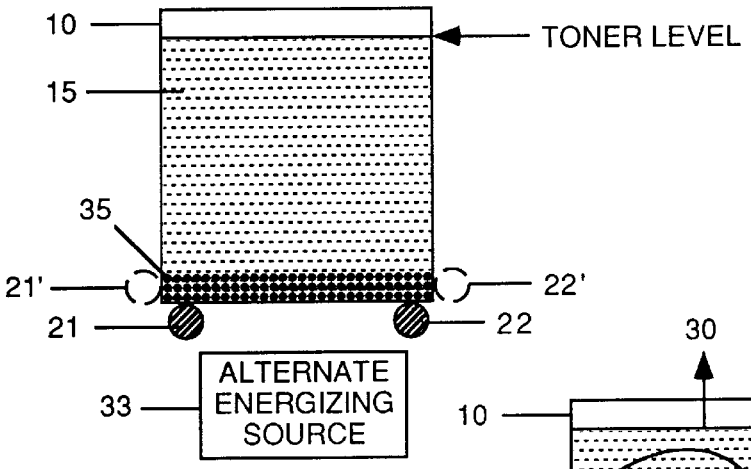
FIGS. 4A, 4B, 4C, and 4D are side views of a reservoir containing toner, with two alternately-energized, external heating elements in accord with the invention.

FIGS. 1A, 1B, 1B', 2A, and 2B

10 Reservoir

15 Toner

20 Heating element

25 Flow direction arrow

26 Toner pigment particle

27 Resin surrounding toner pigment particle

30 Heat flow arrow

32 Wires

FIGS. 3A, 3B, 3C, and 3D

20 ' Heater at alternate location

35 Pigment or dye particles

40 Horizontal datum

FIGS. 4A, 4B, 4C, 4D, 5A, 5B, and 5C

21 External heater

21' External heater at alternate location

22 External heater

22' External heater at alternate location

33 Alternating energizing source

Figure 6A:
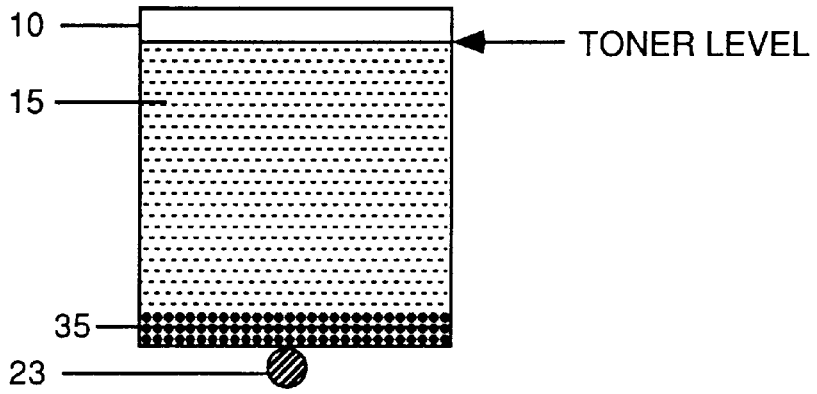
FIGS. 6A, 6B, and 6C are side views of a reservoir containing toner, with one continuously-energized, external heating element in accord with the invention.
Figure 6B:
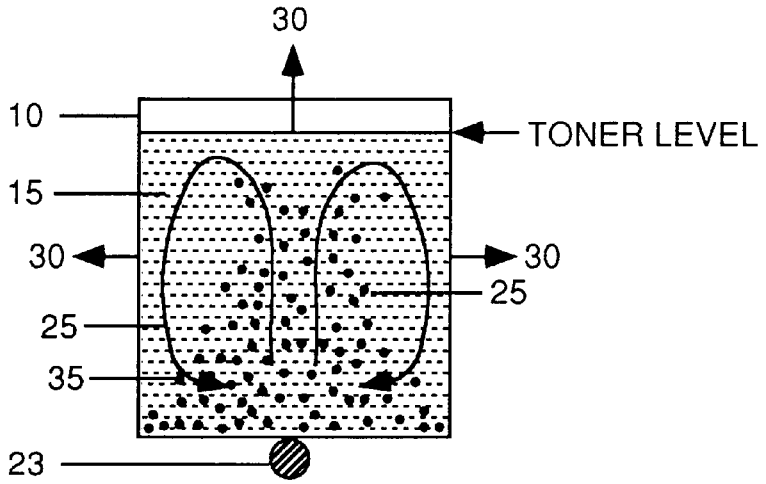
Figure 6C:
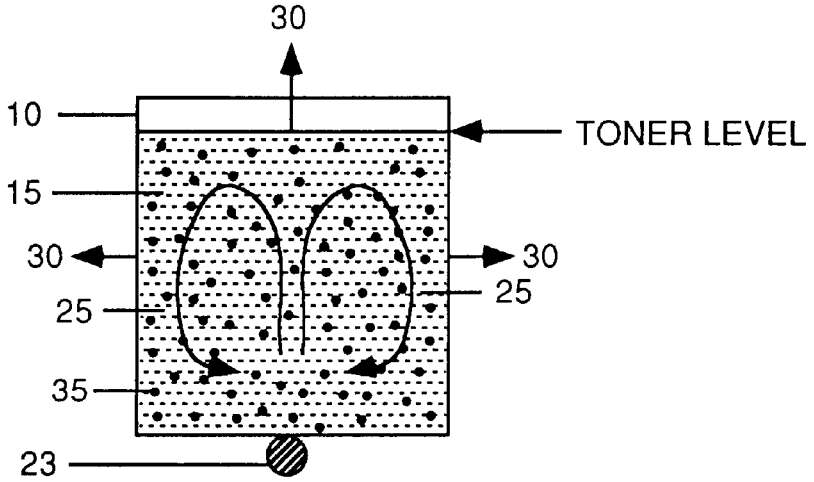

FIGS. 6A, 6B, and 6C

23 Centrally-located, external heater

Figure 7A:
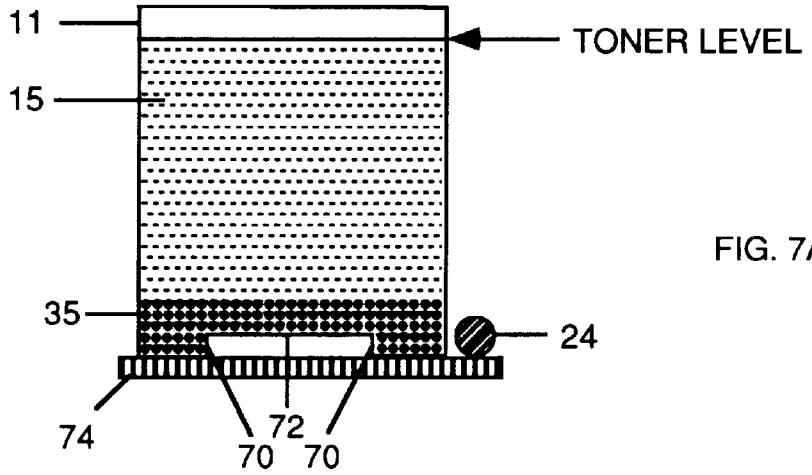
FIGS. 7A, 7B, and 7C are side views of a reservoir containing toner with two convex projections and one continuously-energized, externally-heated surface in contact with the projections in accord with the invention.
Figure 7B:
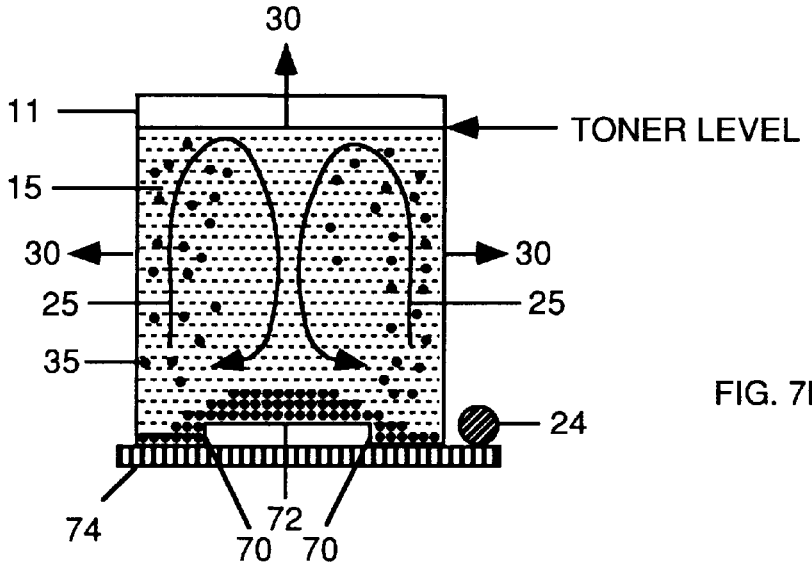
Figure 7C:
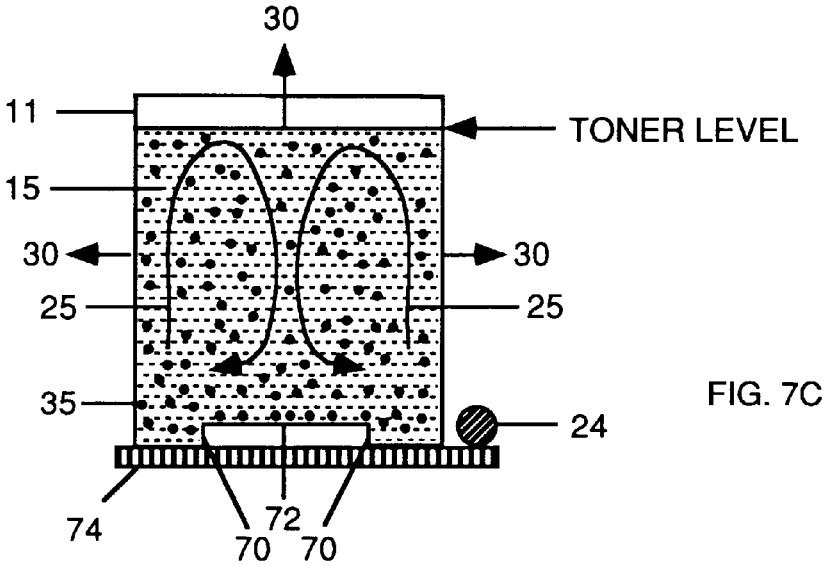

FIGS. 7A, 7B, and 7C

11 Reservoir with two convex projections

24 External heater on heating plate

70 Convex projections

72 Center portion of reservoir

74 Heating plate

The Immersed Heating Element—FIGS. 1A and 1B

FIG. 1A shows a front view of a reservoir 10 containing toner 15 and a heating element 20 located within the reservoir. Toner 15 contains particles which would normally settle to the bottom of reservoir 10 and other agents which do not settle but remain in solution in the liquid vehicle. These particles typically comprise minutely-milled pigments 26, which are surrounded by a clear, plastic resin 27 (FIG. 1B). The diameter of the particle, including resin 27, is typically less than one micron. The chemical bonds within the resin interact with the chemistry of other, trade-secret, compounds dissolved within the toner vehicle. This interaction causes the particles to have an electrical charge. This electrical charge is opposite in sign to the image charge, described supra, which is deposited on the print medium. Thus during flooding of the medium by the toner, the charged particles adhere to the medium where the image charge has been previously deposited.

A typical electrographic toner reservoir like reservoir 10 is 6 inches (15.2 cm) wide, 8.5 inches (21.6 cm) deep, and 9.5 inches (24.1 cm) high. It contains 1.5 gallons (5.68 liter) of liquid toner. Other sizes are also available. Heating element 20 is preferably a resistive heater which is connected by wires 32 to an external energy source (not shown). Since toner 15 contains charged particles which react to the presence of an electrical field, heater 20 is encased in an insulating jacket (not shown). This prevents toner 15 from interacting with heater 20 when it is energized. The power emitted by heater 20 when it is energized is typically between 1 and 10 watts when used in a 1.5 gallon (5.68 liter) reservoir. Heater 20 can alternatively be heated by an external source of steam or other fluid (not shown). Heater 20 can also alternatively be heated by the action of a source of friction (not shown) which creates heat.

When heater 20 is energized, it heats the surrounding toner 15. The energy supplied to heater 20 is moderate so that the temperature of heater 20 typically does not exceed the boiling point of toner 15. Heater 20 typically attains a temperature of 100 deg. F (37.8 deg. C). Since it is in contact with heater 20, the volume of toner 15 adjacent to heater 20 reaches the same temperature due to thermal conduction. The temperature of heater 20 and adjacent toner 15 does not increase beyond about 100 deg. F (37.8 deg. C) since such heat is dissipated to the ambient surroundings. Because of this dissipation, the temperature of toner 15 at locations away from heater 20 remains very near the temperature of the ambient surroundings. When toner 15 is heated, its density in the vicinity of the heater decreases. Because of the local density decrease due to heating by heater 20, the toner in the vicinity of heater 20 will rise. The rising toner will follow the path indicated by arrow 25. This will continue until all the toner in the reservoir reaches the temperature of heater 20. In the absence of a temperature gradient in toner 15, flow following the path of arrow 25 stops.

Since the heat in the toner from heater 20 is permitted to leave reservoir 10, as indicated by heat flow arrows 30, a thermal gradient is established in toner 15 and flow, indicated by arrow 25, will continuously occur. The heat supplied by heater 20 and subsequently dissipated to the ambient is typically between one and 10 watts for a 1.5 gallon (5.68 liter) reservoir, or on a unit volume basis 6.67 watts/gallon (1.17 watts/liter). The process of fluid flow due to thermal gradients alone is called "natural convection," or simply convection. This concept is well understood by those familiar with the science of thermodynamics.

The External Heating Element—FIGS. 2A and 2B

FIGS. 2A and 2B show front and side views, respectively, of a reservoir 10 containing toner 15 an d an external heating element 20. If reservoir 10 is thermally conductive, heat may be applied externally. The consequences of external heat application are the same as described supra for an immersed heater 20. Heater 20 may be a resistive heater with an insulated element. It can be strapped to reservoir 10, or simply placed underneath it. Such an arrangement can easily be added to existing printers as a retrofit.

First Preferred Embodiment—External Heat Source and Tilt ed Reservoir—FIGS. 3A, 3B, 3C, and 3D FIG. 3A shows a rectangular reservoir 10 containing toner 15 in which particles 35 have settled to the bottom under the influence of gravity. Reservoir 10 is tilted at an angle θ, typically between 5 and 10 degrees in order to enhance the effectiveness of its single heater 20. The tilt causes toner particles 35 to settle above heater 20. The rate of convection will be greatest above heater 20 so, for stirring purposes, this is the most advantageous location for particles 35. Heater 20 is OFF. Since the contents are at thermal equilibrium, there is no convective flow of toner 15. Heat may be optionally be applied on the side of reservoir 10 by heater 20'. The resultant convective effect is equivalent.

FIG. 3B shows the contents of reservoir 10 after heater 20 has been ON for a short period, typically a few minutes. Heat enters reservoir 10 at the point of contact with heater 20. Heat leaves reservoir 10 from at least one location, as indicated by heat-flow arrow 30. Because of the thermal gradient thus established, toner 15 will engage in convective flow along the path indicated by arrow 25. Previously-settled particles 35 are entrained in this flow and begin to move with it, departing from their original positions.

FIG. 3C shows the positions of particles 35 after heater 20 has been ON for a longer period, typically ten minutes. Under the influence of convective flow 25, particles 35 begin to disperse throughout the volume of toner 15.

FIG. 3D shows the positions of particles 35 after heater 20 h as been ON for a very long time, typically more than one hour. The stirring action of convective flow 25 has caused the particles to be evenly dispersed in the volume of toner 15. Toner 15 is thus homogeneous and is now suitable for use in electrographic printing.

Second Preferred Embodiment—Two Alternately-Energized Heat Sources and One Reservoir—FIGS. 4A, 4B, 4C, and 4D FIG. 4A shows reservoir 10 with two heat sources 21 and 22. Two heat sources are required when reservoir 10 is of such extent that the convective flow from the vicinity of source 21 does not reach the side of reservoir 10 adjacent to heater 22. Heat sources 21' and 22', equivalent to sources 21 and 22, are optionally located on the sides of reservoir 10. In a very large reservoir, such as the 1.5 gallon (5.68 liter) reservoir described supra, it is advantageous to provide more than one heat source. Heat sources 21 and 22 (21' and 22') have been OFF for a long time and particles 35 in toner 15 have settled to the bottom of reservoir 10, as described supra.

To stir toner 15, heat sources 21 and 22 (21' and 22') are preferably energized alternately by an alternating energizing source 33. The ON and OFF periods of heaters 21 and 22 (21' and 22') are typically three hours, with a duty cycle of 50%, i.e. heater 21 (21') is ON and heater 22 (22') is OFF for three hours, then heater 21 (21') is OFF and heater 22 (22') is ON for three hours, and so on. Heat escapes from reservoir 10, and hence toner 15, as shown by heat-flow arrows 30. The heater which is ON, and thus the adjacent toner, typically attains a temperature of 100 deg. F (37.8 deg. C). The heater which is OFF typically reverts to the ambient temperature.

Figure 4B:
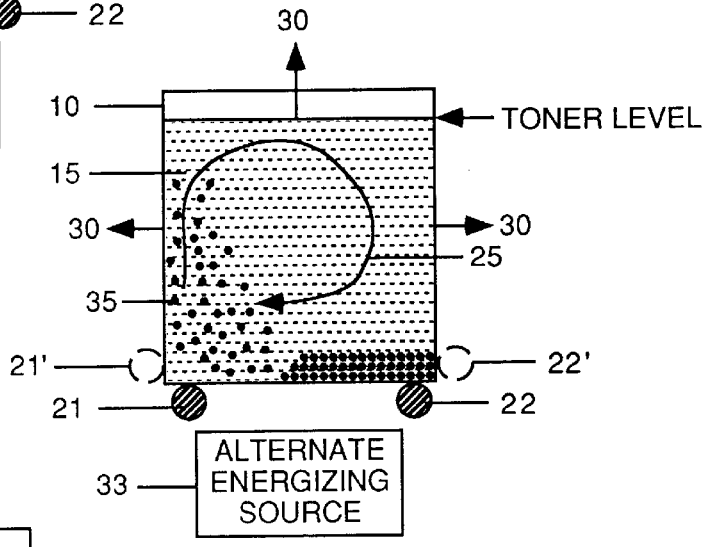

FIG. 4B shows the positions of particles 35 in toner 15 after heater 21 (21') has been ON for a brief period, approximately ten minutes. Heater 22 (22') is OFF. In this case, reservoir 10 is sufficiently large that the rate of convective flow 25 is inadequate to entrain particles 35 in the vicinity of heater 22 (22'). Thus only particles in the vicinity of heater 21 (21') are distributed in the volume of toner 15.

Figure 4C:
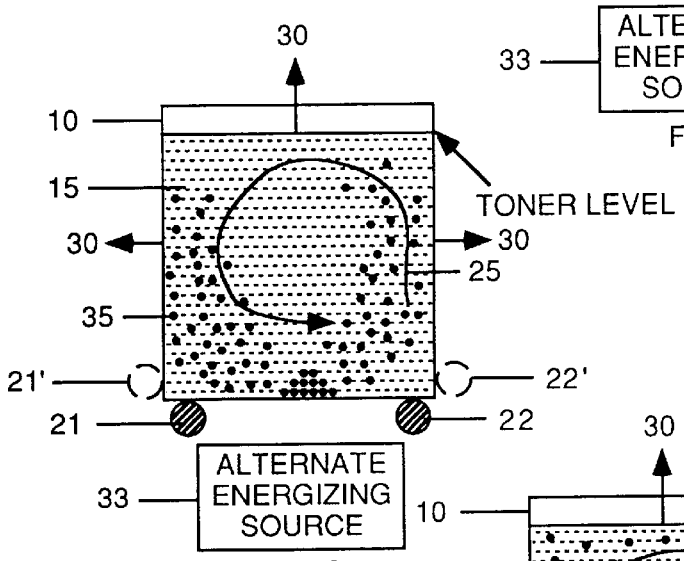

FIG. 4C shows the positions of particles 35 in toner 15 after heater 22 (22') has been ON for a brief period after heater 21 (21') has been turned OFF. Particles 35 adjacent to the position of heater 22 (22') are now entrained in convective flow 25, which now moves in the opposite direction from that in FIG. 4B. Since particles 35 settle only very slowly, those distributed during the ON cycle of heater 21 (21') will remain suspended along with those distributed during the ON cycle of heater 22 (23').

Figure 4D:
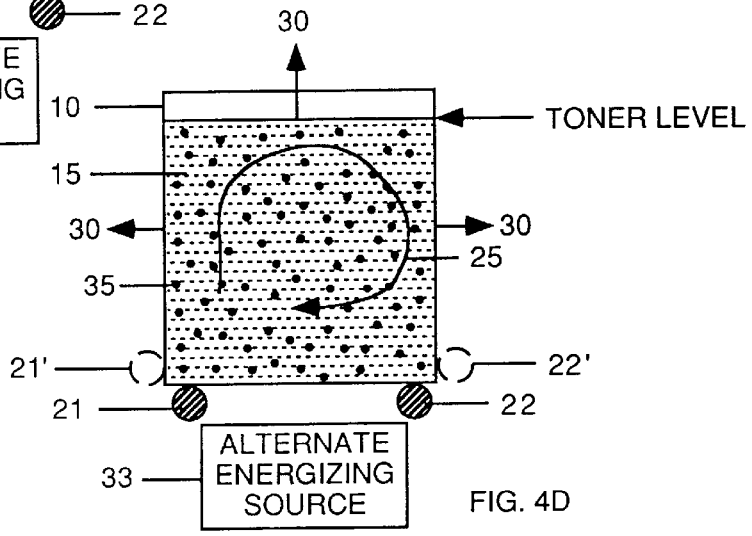

FIG. 4D shows the positions of particles 35 after heaters 21 and 22 (21' and 22') have been cycled for a long time, typically 12 hours. Particles 35 will remain suspended as long as heaters 21 and 22 (21' and 22') are alternately cycled ON and OFF in the manner described supra. The toner in FIG. 4D is now fully homogeneous and suitable for use in electrographic printing.

Figure 5A:
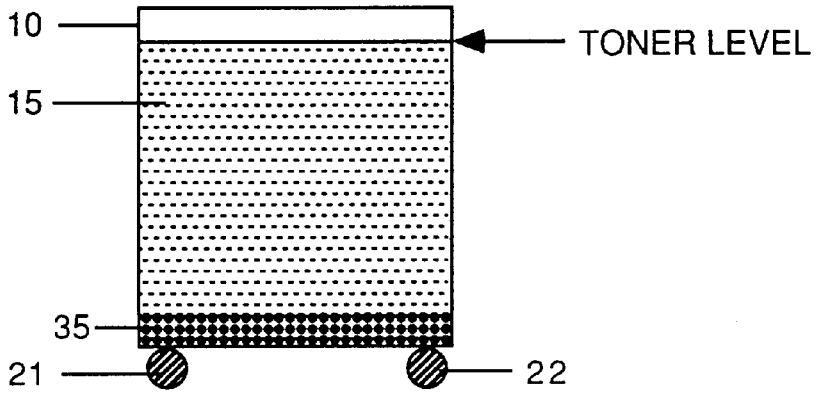
FIGS. 5A, 5B, and 5C are side views of a reservoir containing toner, with two simultaneously-energized, external heating elements in accord with the invention.
Figure 5B:
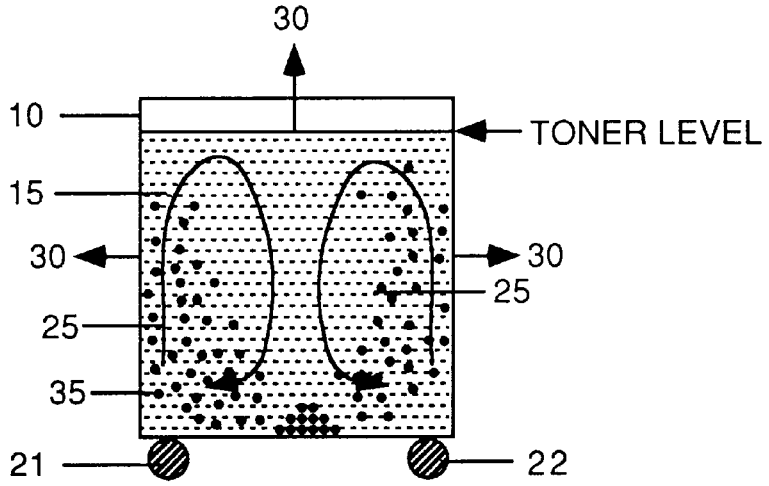
Figure 5C:
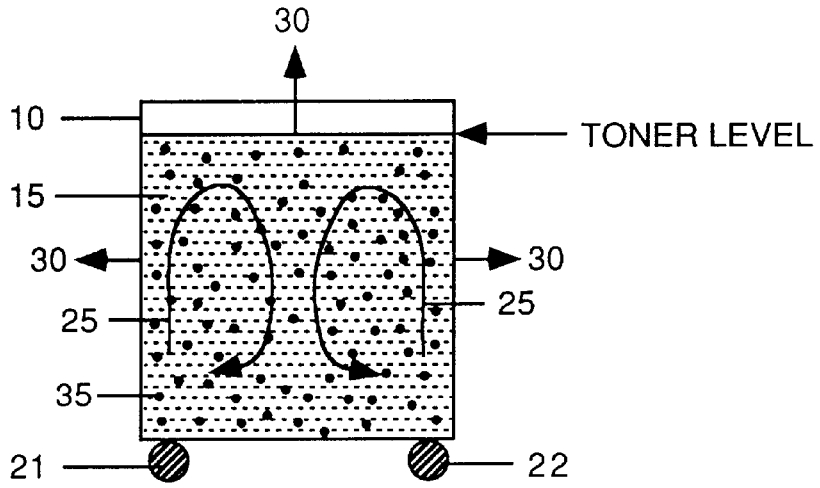

Third Preferred Embodiment—Two Simultaneously-Energized Heat Sources and One Reservoir—FIGS. 5A, 5B, and 5C As in the case of FIGS. 4, in a very large reservoir, such as the 1.5 gallon (5.68 liter) reservoir described supra, it may be advantageous to provide more than one heat source. FIG. 5A shows reservoir 10 with two heat sources 21 and 22. Two heat sources are required when reservoir 10 is of such extent that the convective flow from the vicinity of source 21 does not reach the side of reservoir 10 adjacent to heater 22 and vice-versa. Heat sources 21' and 22', equivalent to sources 21 and 22, are optionally located on the sides of reservoir 10. Heat sources 21 and 22 (21' and 22') have been OFF for a long time and particles 35 in toner 15 have settled to the bottom of reservoir 10, as described supra.

To stir toner 15, heat sources 21 and 22 (21' and 22') are preferably energized simultaneously and continuously by a power source (not shown). Heaters 21 and 22 (21' and 22') typically attain a temperature of 100 deg. F (37.8 deg. C). Toner 15 immediately adjacent each heater reaches a temperature of nearly 100 deg. F (37.8 deg. C) by virtue of conduction through the bottom of reservoir 10.

FIG. 5B shows the positions of particles 35 in toner 15 after heaters 21 and 22 (21' and 22') have been ON for a brief period, approximately ten minutes.

FIG. 5C shows the positions of particles 35 in toner 15 after heaters 21 and 22 (21' and 22') have been ON for a long time, typically 12 hours. Particles 35 will remain suspended as long as heaters 21 and 22 (21' and 22') remain ON. The toner in FIG. 5C is now fully homogeneous and suitable for use in electrographic printing.

Fourth Preferred Embodiment—One Heat Source and One Large Reservoir—FIGS. 6A, 6B, and 6C FIGS. 6A, 6B, and 6C show a single heat source 23 located near the middle of reservoir 10. In some instances, the convective flow from a single heat source is adequate to ensure that adequate convective flow reaches both distal sides of reservoir 10 to entrain the particles there. Heat source 23 extends perpendicular to the drawing and resides underneath reservoir 10. Heat source 10 is preferably continuously energized. FIG. 6A shows the location of particles 35 after heater 23 has been OFF for a very long time. FIG. 6B shows the location of particles 35 after heater 23 has been energized for several minutes. FIG. 6C shows the location of particles 35 after heater 23 has been energized for tens of minutes.

Fifth Preferred Embodiment—One Heat Source and One Large Reservoir with Convex Projections—FIGS. 7A, 7B, and 7C FIGS. 7A, 7B, and 7C show a side view of reservoir 11 with two convex projections 70 which extend across the width of reservoir 11. Projections 70 are in physical and thermal contact across their width with heating plate 74. Reservoir 11 is sufficiently thermally conductive that the portion of toner 15 which is adjacent the bottom of projections 70 is very nearly at the temperature of plate 74. Plate 74 is made of thermally conductive material such as aluminum and is typically 0.125 inch (0.32 cm) thick. It is heated by energized heater 24, which is in thermal contact with plate 74. Heater 24 is preferably continuously energized, although it may also be intermittently energized. In the case of a resistive heater, the resistive elements in heater 24 are typically electrically insulated from plate 74. Projections 70 are separated by a raised region 72. Region 72 is not in thermal contact with plate 74.

Operation of this embodiment is similar to that shown in FIGS. 5, except that only a single heater is required. FIG. 7A shows the position of toner particles 35 in reservoir 11 after heater 24 has been OFF for a period of time sufficient to allow particles 35 to settle to the bottom of reservoir 11. FIG. 7B shows the positions of particles 35 after heater 24 has heated plate 74 for a short period of time, typically five minutes. FIG. 7C shows the uniform distribution of particles 35 after heater 24 has heated plate 74 for an extended period of time, typically five hours.

SUMMARY, RAMIFICATIONS, AND SCOPE

It will be seen that the instant convective stirring system solves a critical problem in electrographic printers: the maintenance of homogeneity of the toner supply. Prior-art electrographic printers relied on recirculation of the toner supply with mechanical pumps. The flow associated with this pumping did not adequately distribute pigment or dye particles within the bulk volume of the toner. Poor print quality resulted from the inadequate mixing of toner prior to its deposition on the receiving medium. The instant system solves this problem. It is reliable, in expensive, and simple.

Other fluids may be stirred by the method of the present system. For example, it can be used to maintain colloidal suspensions of paints or medications in an homogeneous condition prior to dispensing.

Instead of two heaters disparately dispose d and alternately energized under a reservoir, a single heater may be used at the center of the reservoir. Instead of being located on the bottom of the reservoir, the heaters may be located on the sides of the reservoir.

The applied power and resultant temperature of the toner near the heater can vary from slightly above ambient to boiling. The heater can be thermostatically controlled.

Other heat sources are possible. Instead of a resistive heater, a heat lamp may be used. Other heat sources include a pipe heated by a fluid such as steam, a heater which derives its heat from dissipation in a semiconductor, or a heater which derives its heat from friction.

Timing scenarios other than a 50% duty cycle with a period of several hours can be used. In a small reservoir, it may be desirable to use a one-minute period, for example. If the toner reservoir is asymmetric, a 10–90% duty cycle may be more appropriate.

Instead of rectangular, the reservoir can assume circular, oval, triangular, hexagonal and other shapes.

While the present system employs elements which are well known to those skilled in the arts of thermodynamics and fluid flow, it combines elements from these fields in a novel way which has heretofore not been applied in the field of electrographic printing. The instant invention does not only evenly distribute particulates, but it also ensures that electrical conductivity control agents which are dissolved in the liquid vehicle are homogeneously mixed within the toner reservoir.

Accordingly the scope of this invention should be determined, not by the embodiments illustrated, but by the appended claims and their legal equivalents.

I claim:

1. A method for stirring toner fluid in a reservoir, comprising:

providing a reservoir containing a toner fluid comprising a solvent liquid and microscopic particles of toner comprising colored particles and resins, and creating a thermal gradient within said fluid so that said particles are entrained in the convective flow resulting from said thermal gradient and said fluid is thereby stirred so as to disperse said particles homogeneously.

2. The method of claim 1 wherein said thermal gradient is created by providing a heater external to said reservoir.

3. The method of claim 1 wherein said thermal gradient is created by providing a heater internal to said reservoir.

4. A system for stirring a particle-containing electrographic toner fluid, comprising:

a. a reservoir containing an electrographic toner fluid with solids and dissolved agents, and b. at least one heater in sufficient thermal contact with said fluid to create a thermal gradient within said fluid so that said particles are entrained in the convective flow resulting from said thermal gradient and said fluid is thereby stirred so as to disperse said particles and said dissolved agents.

5. The system of claim 4 wherein said heater is located inside said reservoir.

6. The system of claim 4 wherein said heater is located outside said reservoir.

7. The system of claim 4 wherein said heater comprises at least two individual heat sources at separate locations, and further includes means for alternately energizing said sources.

8. The system of claim 7 wherein said heat sources are electrically activated.

9. A system for stirring a particle-containing electrographic toner fluid, comprising:

a. a thermally-conductive reservoir containing said fluid and having at least one convex projection, b. at least one heater and one heating plate, said heater being in thermal contact with said heating plate, said heating plate also being in thermal contact with said convex projection, said heater arranged to create a thermal gradient within said fluid so that the particles in said fluid are entrained in the convective flow resulting from said thermal gradient and said fluid is thereby stirred.

10. The system of claim 9 wherein said heater is intermittently energized.

11. The system of claim 9 wherein said heater is continuously energized.

12. The system of claim 9 wherein said heater provides about 7 watts/gallon (1.2 watts/liter).

* * * * *